US006365316B1

(12) United States Patent
Stamp et al.

(10) Patent No.: US 6,365,316 B1
(45) Date of Patent: Apr. 2, 2002

(54) TONER AND DEVELOPER PROVIDING OFFSET LITHOGRAPHY PRINT QUALITY

(75) Inventors: Amy L. Stamp; William H. Hollenbaugh, Jr., both of Rochester; Susan J. Lafica, Fairport; Timothy J. Key, Rochester; Scott M. Silence, Fairport; Michael J. Duggan, Webster; Merrilee A. Galloway, Macedon; Dennis A. Mattison, Jr., Ontario; William T. Delelys, Webster; Kenneth D. Henderson, Rochester; Gerardo Leute, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/520,439

(22) Filed: Mar. 7, 2000

(51) Int. Cl.[7] ..... G03G 9/08; G03G 9/087

(52) U.S. Cl. ..... 430/111.41; 430/107.1; 430/109.4; 430/110.4; 430/111.35; 430/111.4

(58) Field of Search ..... 430/106, 109, 430/110, 111, 111.41, 111.4, 110.4, 109.4, 107.1, 108.6, 108.7, 108.3, 111.34, 111.35

(56) References Cited

U.S. PATENT DOCUMENTS

| | | | | | |
|---|---|---|---|---|---|
| 3,590,000 | A | | 6/1971 | Palermiti et al. | |
| 3,847,604 | A | | 11/1974 | Hagenbach et al. | |
| 4,298,672 | A | | 11/1981 | Lu | 430/108 |
| 4,338,390 | A | | 7/1982 | Lu | 430/106 |
| 4,558,108 | A | | 12/1985 | Alexandru et al. | 526/340 |
| 4,868,600 | A | | 9/1989 | Hays et al. | 430/120 |
| 4,935,326 | A | | 6/1990 | Creatura et al. | 430/108 |
| 4,937,166 | A | | 6/1990 | Creatura et al. | 430/108 |
| 5,227,460 | A | | 7/1993 | Mahabadi et al. | 528/272 |
| 5,480,756 | A | * | 1/1996 | Mahabadi et al. | 430/109 |
| 5,506,083 | A | * | 4/1996 | Nash et al. | 430/106 |
| 5,543,259 | A | * | 8/1996 | Schwartz et al. | 430/106 |
| 5,545,501 | A | | 8/1996 | Tavernier et al. | 430/106.6 |
| 5,561,013 | A | * | 10/1996 | O'Brien et al. | 430/109 |
| 5,569,567 | A | | 10/1996 | Tavernier et al. | |
| 5,622,803 | A | | 4/1997 | Tavernier et al. | |
| 5,912,099 | A | * | 6/1999 | Kanbayashi et al. | 430/106 |
| 5,916,722 | A | | 6/1999 | Creatura et al. | |
| 5,978,633 | A | | 11/1999 | Hirsch et al. | 399/266 |
| 6,004,714 | A | * | 12/1999 | Ciccarelli et al. | 430/110 |
| 6,087,059 | A | * | 7/2000 | Duggan et al. | 430/111 |
| 6,156,469 | A | * | 12/2000 | Sato | 430/106 |
| 6,242,145 | B1 | * | 6/2001 | Galloway et al. | |

FOREIGN PATENT DOCUMENTS

| | | | | |
|---|---|---|---|---|
| EP | 330498 | * | 8/1989 | 430/111 |
| EP | 0 980 030 A | | 2/2000 | |
| EP | 1 065 570 A | | 1/2001 | |

OTHER PUBLICATIONS

Gutman, E. Y., et al., *Journal of Imaging Science and Technology*, vol. 36 (Jul./Aug. 1992), pp. 335–349.*

* cited by examiner

*Primary Examiner*—Janis L. Dote
(74) *Attorney, Agent, or Firm*—Oliff & Berridge, PLC; Eugene O. Palazzo

(57) ABSTRACT

A toner for particular use in devices utilizing hybrid scavengeless development includes toner particles of at least one binder, at least one colorant, and optionally one or more additives, the toner exhibiting a charge per particle diameter (Q/D) of from −0.1 to −1.0 fC/$\mu$m with a variation during development of from 0 to 0.25 fC/$\mu$m and the distribution is substantially unimodal and possesses a peak width of less than 0.5 fC/$\mu$m, and the toner has a triboelectric charge of from −25 to −70 $\mu$C/g with a variation during development of from 0 to 15 $\mu$C/g following triboelectric contact with carrier particles. Use of a toner with such properties in a hybrid scavengeless development apparatus enables images to be achieved with properties similar to that achieved in offset lithography.

24 Claims, No Drawings

TONER AND DEVELOPER PROVIDING OFFSET LITHOGRAPHY PRINT QUALITY

BACKGROUND OF THE INVENTION

1. Field of Invention

This invention relates to toners, a method of making the toners, developers containing the toners, a method of making coated carriers for the developers, and a method of forming images of offset-like print quality with the developers. More in particular, the invention relates to toners and developers having carefully controlled properties to that provide offset-like print quality when used in developing electrostatic images with a device containing a hybrid scavengeless development system.

2. Description of Related Art

Historically, xerography has not been required to deliver prints of the same caliber as offset lithography. The offset lithography customer demands a level of print quality much higher than is available from conventional xerographic machines.

U.S. Pat. No. 5,545,501 describes an electrostatographic developer composition comprising carrier particles and toner particles with a toner particle size distribution having a volume average particle size (T) such that 4 $\mu$m$\leqq$T$\leqq$12 $\mu$m and an average charge (absolute value) per diameter in femtocoulomb/10 $\mu$m ($C_t$) after triboelectric contact with said carrier particles such that 1 fC/10 $\mu$m$\leqq C_t \leqq$10 fC/10 $\mu$m characterized in that (i) said carrier particles have a saturation magnetization value, $M_{sat}$, expressed in Tesla (T) such that $M_{sat} \geqq 0.30$ T, (ii) said carrier particles have a volume average particle size ($C_{avg}$) such that 30 $\mu$m$\leqq C_{avg} \leqq$60 $\mu$m, (iii) said volume based particle size distribution of said carrier particles has at least 90% of the particles having a particle diameter C such that 0.5 $C_{avg} \leqq C \leqq 2\ C_{avg}$, (iv) said volume based particles size distribution of said carrier particles comprises less than b % particles smaller than 25 $\mu$m wherein b=0.35 $\times(M_{sat})^2 \times P$ with $M_{sat}$: saturation magnetization value, $M_{sat}$, expressed in T and P: the maximal field strength of the magnetic developing pole expressed in kA/m, and (v) said carrier particles comprise a core particle coated with a resin coating in an amount (RC) such that 0.2% w/w$\leqq$RC$\leqq$2% w/w. See the Abstract. This patent describes that such developer achieves images of offset-quality in systems in which a latent image is developed with a fine hair magnetic brush. See column 4, lines 7–17.

What is still desired is a set of developers comprised of toners and carriers that possess a combination of properties such that when used to develop a latent image on the surface of a photoreceptor, preferably in an image-on-image device, more preferably in a device utilizing a hybrid scavengeless development system, the color image produced in this xerographic manner exhibits a quality analogous to that achieved in offset lithography.

SUMMARY OF THE INVENTION

It is an object of the present invention to provide a set of color toners and developers each having a set of properties such that the developers containing such toners can achieve xerographically produced images having offset-like print quality. It is a further object of the invention to develop such set of color toners and developers capable of producing such images when used in a development device utilizing a hybrid scavengeless development system.

It is a still further object of the invention to provide a method for manufacturing the toners and developers to consistently achieve the required properties.

It is a still further object of the invention to develop suitable carriers for use in combination with the toners in order to obtain two component developers possessing the required properties. It is a still further object of the invention to develop a preferred method of manufacturing coated carriers for use in combination with the toners in order to obtain two component developers possessing the required properties.

DETAILED DESCRIPTION OF PREFERRED EMBODIMENTS

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed.

In the present invention, two-component developer materials are used in the first step of the development process. A typical two-component developer comprises magnetic carrier granules having toner particles adhering triboelectrically thereto. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One type of color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50–200 $\mu$m, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700–900 Vpp at frequencies of 5–15 kHz. These AC signals are often square waves, rather than pure sinusoidal waves. Toner from the cloud is then developed onto the nearby photoreceptor by fields created by a latent image.

In the present invention, while any suitable electrostatic image development device may be used, it is most preferred to use a device employing the hybrid scavengeless development system. Such a system is described in, for example, U.S. Pat. No. 5,978,633, the entire disclosure of which is incorporated herein by reference.

Satisfaction of stringent offset-like print quality requirements in a xerographic engine has been enabled in the present invention by IOI xerography of which hybrid scavengeless development is a preferred subsystem component. Both the image quality and the unique subsystem requirements result in highly constrained toner designs. This invention describes the aspects of novel toners that operate in this restrictive atmosphere to produce prints of near offset quality.

In addition to achieving offset-like print quality, the digital imaging processes of the above-described device also enables customization of each print (such as an address, or special information for regional distribution), which is not practical with offset lithography.

This invention describes a unique combination of toner, toner manufacturing process, developer, and carrier properties to enable a materials set to ideally function in the restrictive atmosphere of the device discussed above. The toner properties and specific toner embodiments are discussed in Sections A–F and the text that follows Section F, the parameters of the toner manufacturing process and specific process embodiments are discussed in the text that follows the text of the toner property set, the developer properties and specific developer embodiments are discussed in Sections G–K and the text that follows Section K, and the carrier properties and specific carrier embodiments are discussed in the text that follows the text of the developer property set.

The toners of the invention deliver prints that will delight the customer with vivid (high Chroma), reliable color rendition. Color gamut, the maximum set of colors that can be printed, is benchmark for a four-color xerographic system. Solid and halftone areas are uniform and stable in density and color. They are of uniform gloss. Pictorials contain accurate, realistic rendition. Text is crisp with well-defined edges regardless of font size or type. There is no background. Color, solids, halftones, gloss, pictorials, text and background are stable over the entire job run. The prints do not exhibit objectionable paper curl, nor are the images disturbed by handling or storage, for example when stored in contact with vinyl or other document surfaces.

To meet these print quality attributes, toner materials must operate in a consistent, predictable manner. The most significant toner material parameters enabling the toners to so operate, particularly in the hybrid scavengeless development system atmosphere, are toner size distribution, toner melt flow and rheology, toner blocking temperature, resistance to offset against vinyl and other document surfaces, toner color, toner flow, and toner charge distribution.

Below are listed the toner material parameters and the print quality attributes that the parameters influence. Preferred values for the various properties are also described.

A. Toner Particle Size Distribution

Small toner size enables the reduction of TMA (transferred mass per unit area). This is especially important for Image-On-Image process color systems whereby color toners are layered. High mass of toner on paper causes objectionable document "feel" (unlike lithography), stresses fusing latitude, and increases paper curl. In addition, developability degradation can occur when a second or third toner layer is developed onto the first toner layer, due to development voltage non-uniformity. While it is desirable to have as small an average toner particle size as possible, there are failure modes identified with extremely small particles. Extremely fine toner particles are a stress to xerographic latitude as they exhibit increased toner adhesion to carrier beads, donor rolls and photoreceptors. Toner fines are also related to development instability, due to the lower efficiency of donor roll development of very small particles. Fine toner particles exhibit increased adhesion to the photoreceptor, impairing transfer efficiency and uniformity. The presence of coarse toner particles is related to HSD wire strobing and interactivity, and compromises the rendering of very fine lines and structured images.

Therefore, it is desirable to control the toner particle size and limit the amount of both fine and coarse toner particles. Small toner size is required for use in the present invention in order to enable high image quality and low paper curl. Narrow toner size distributions are also desired, with relatively few fine and coarse toner particles. In a preferred embodiment of the invention, the finished toner particles have an average particle size (volume median diameter) of from about 6.9 to 7.9 microns, most preferably of from about 7.1 to 7.7 microns, as measured by the well known Coulter counter technique. The fine side of the toner distribution is well controlled with about 30% or less of the number distribution of toner particles (i.e., the total number of toner particles) having a size less than 5 microns, most preferably only about 15% of the number distribution of toner particles having a size less than 5 microns. The coarse side of the distribution is also very well controlled, with about 0.7% or less of the volume distribution of toner particles having a size greater than 12.7 microns. This translates into a very narrow particle size distribution with a lower volume ratio geometric standard deviation (GSD) of approximately 1.23 and an upper volume GSD of approximately 1.21. The toners thus require small average particle size and a narrow particle size distribution.

B. Toner Melt Rheology

As process speed increases, dwell time through the fuser decreases, resulting in lower toner-paper interface temperatures. During the fusing event, it is necessary for toner particles to coalesce, flow and adhere to the substrate (for example, paper, transparency sheets, etc.) at temperatures that are consistent with the device process speeds. It is also necessary for the melt viscosity at the device fusing conditions to provide the required gloss level, while maintaining a high enough elasticity to prevent fuser roll hot-offset (i.e., transfer of toner to the fuser roll). Occurrence of offset results in print defects and a reduction of fuser roll life.

Therefore, it is desirable to choose an appropriate toner binder resin and control its melt rheology to provide low minimum fuse temperature, broad fusing latitude and desired gloss at the machine operating conditions. It is further desirable to use an appropriate binder resin such that the toner enables long fuser roll life.

The functionality required for the toners of the present invention is a controlled melt rheology which provides low minimum fuse temperature, broad fusing latitude and desired gloss at the machine operating conditions. The minimum fusing temperature is generally characterized by the minimum fix temperature (MFT) of the fusing subsystem (i.e., the lowest temperature of fusing that the toner will fix to substrate paper well, as determined by creasing a section of the paper with a toned image and quantifying the degree to which the toner in the crease separates from the paper). The fusing latitude is generally determined to be the difference between the hot offset temperature (HOT) (i.e., the highest temperature of fusing that can be conducted without causing toner to offset to the fusing roll, as determined by the presence of previous images printed onto current images or the failure of the paper to release from the fuser roll) and the MFT. The gloss level of the fused toner layer (i.e., the shininess of the fused toner layer at a given fusing temperature as determined by industry standard light reflection measurement) is also dependent on the temperature at which the toner is fused, and can further restrict the fusing latitude; that is, if the gloss level of the toner becomes too high at a temperature below the HOT or too low at a temperature above the MFT this restricted range of temperatures will serve to define the fusing latitude.

The melt rheology profile of the toner must be optimized to give the lowest minimum fusing temperature and broadest fusing latitude. The melt rheology profile of the toner which is enabling in the present invention has a viscosity of between $3.9\times10^4$ and $6.7\times10^4$ Poise at a temperature of 97° C., a viscosity of between $4.0\times10^3$ and $1.6\times10^4$ Poise at a temperature of 16° C., and a viscosity of between $6.1\times10^2$ and $5.9\times10^3$ Poise at a temperature of 136° C. The melt rheology profile of the toner which is enabling in the present invention further has an elastic modulus of between $6.6\times10^5$ and $2.4\times10^6$ dynes per square centimeter at a temperature of 97° C., an elastic modulus of between $2.6\times10^4$ and $5.9\times10^5$ dynes per square centimeter at a temperature of 116° C., and an elastic modulus of between $2.7\times10^3$ and $3.0\times10^5$ dynes per square centimeter at a temperature of 136° C. Both the viscosity and elastic modulus are determined by measurement using a standard mechanical spectrometer at 40 radians per second. An alternate method of characterizing the toner rheology is by measurement of the melt flow index (MFI), defined as the weight of a toner (in grams) which passes through an orifice of length L and diameter D in a 10 minute period with a specified applied load. The melt rheology profile of the toner which is enabling in the present invention has an MFI of between 1 and 25 grams per 10 minutes, most preferably between 6 and 14 grams per 10 minutes at a temperature of 117° C., under an applied load of 2.16 kilograms with an L/D die ratio of 3.8. This narrow range of melt rheology profile will provide the required minimum fix, appropriate gloss and the desired hot offset behavior, enabling long fuser roll life.

C. Toner Storage/Vinyl and Document Offset

It has always been a requirement for xerographic toners to be able to be stored and shipped under varying environmental conditions without exhibiting toner blocking. It is well known that toner blocking is chiefly affected by the glass transition temperature (Tg) of the toner binder resin. This resin Tg is directly related to its chemical composition and molecular weight distribution. A resin must be chosen such that blocking is not experienced at typical storage temperatures, which defines the lower limit on Tg. As discussed above, the minimum fuse temperature and gloss must also be satisfied, which, to the extent that it affects melt rheology, defines the upper limit on Tg. The application of surface additives further raises the toner blocking temperature over that which is defined by the glass transition of the toner binder resin.

After documents are created, they are frequently stored in contact with vinyl surfaces such as used in file folders and three ring binders or in contact with the surface of other documents. Occasionally, finished documents are seen to adhere and offset to these surfaces, resulting in image degradation; this is known as vinyl offset in the case of offset to vinyl surfaces or document offset in the case of offset to other documents. Some toner binder resins are more susceptible to this phenomenon than others. The chemical composition of the toner binder resin and the addition of certain ingredients can minimize or prevent vinyl and document offset.

Therefore, it is desirable to choose a toner binder resin with a chemical composition that prevents vinyl and document offset, and possesses an appropriate range of glass transition temperature, to prevent toner blocking under storage without negatively affecting fusing properties.

To prevent blocking at typical storage temperatures, but still meet the required minimum fuse temperature, a resin should be chosen with a Tg on the range of from, for example, 52° C. to 64° C.

D. Toner Color

The toners must have the appropriate color characteristics to enable broad color gamut. The choice of colorants should enable rendition of a higher percentage of standard PANTONE® colors than is typically available from 4-color xerography. Measurement of the color gamut is defined by CIE (Commission International de l'Éclairage) specifications, commonly referred to as CIELab, where L*, a* and b* are the modified opponent color coordinates which form a 3 dimensional space, with L* characterizing the lightness of a color, a* approximately characterizing the redness, and b* approximately characterizing the yellowness of a color. The chroma C* is further defined as the color saturation, and is the square root of the sum of squares of a* and b*. For each toner, Chroma (C*) should be maximized over the entire range of toner mass on paper. Pigment concentration should be chosen so that maximum lightness (L*) corresponds with the desired toner mass on the substrate. All of these parameters are measured with an industry standard spectrophotometer (obtained, for instance, from X-Rite Corp.).

Therefore, it is desirable to choose toner colorants which, when combined, provide a broad set of colors on the print, that is, cover the broadest possible color space as defined in the CIELAB coordinate system, with the ability to render accurately desired pictorials, solids, halftones and text.

E. Toner Flow

It is well known that toner cohesivity can have detrimental effects on toner handling and dispensing. Toners with excessively high cohesion can exhibit "bridging" which prevents fresh toner from being added to the developer mixing system. Conversely, toners with very low cohesion can result in difficulty in controlling toner dispense rates and toner concentration, and can result in excessive dirt in the machine. In addition, in the HSD system, toner particles are first developed from a magnetic brush to two donor rolls. Toner flow must be such that the HSD wires and electric development fields are sufficient to overcome the toner adhesion to the donor roll and enable adequate image development to the photoreceptor. Following development to the photoreceptor, the toner particles must be able to be transferred from the photoreceptor to the substrate.

Therefore, it is desirable to tailor toner flow properties to minimize both cohesion of particles to one another, and adhesion of particles to surfaces such as the donor rolls and the photoreceptor. This provides reliable images due to high and stable development and high and uniform transfer.

The toner flow properties thus must minimize both cohesion of particles to one another, and adhesion of particles to surfaces such as the donor rolls and photoreceptor. Toner flow properties are most conveniently quantified by measurement of toner cohesion, for instance by placing a known mass of toner, for example two grams, on top of a set of three screens, for example with screen meshes of 53 microns, 45 microns, and 38 microns in order from top to bottom, and vibrating the screens and toner for a fixed time at a fixed vibration amplitude, for example for 90 seconds at a 1 millimeter vibration amplitude. A device to perform this measurement is a Hosokawa Powders Tester, available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lesser the flowability of the toner. Minimizing the toner cohesion and adhesion will provide high and stable development and high and uniform transfer. Many additive combinations can provide adequate initial flow enabling development and transfer in HSD systems. It has been learned, however that high concentrations of relatively large external surface additives enable stable development and transfer over a broad range of area coverage and job run length.

F. Toner Charge

Toner charge distributions are correlated with development and transfer (including transfer efficiency and uniformity) performance. Print quality attributes that are affected by toner charge level include overall text quality (particularly the ability to render fine serifs), line growth/shrinkage, halo (a white region at the interface of two colors, also evident when text is embedded on a solid background), interactivity (toner of one color participating in the development process of another color, for instance by being scavenged from the printed area of a first color and being redeveloped into the printed area of a second color), background and highlight/shadow contrast (TRC). Failure modes identified with low toner charge include positive line shrinkage, negative line growth, halo, interactivity, background, poor text/serif quality, poor highlight contrast and machine dirt. Problems associated with high toner charge include low development, low transfer efficiency (high residual mass per unit area), poor shadow contrast and interactivity.

In addition to tailoring the average toner charge level, the distribution of charge must not contain excessive amounts of high or low (especially opposite polarity) toner charge. HSD is very sensitive to low charge toner since all of the toner that reaches the photoreceptor (both image and background) will be recharged during the process. Low charge toner (and certainly toner of the opposite polarity) will likely develop to the background region, and after recharging can be transferred to the print. Low charge toner also contributes to an accumulation of toner on the surface of the wires that are situated between the donor roll and photoreceptor in an HSD development system, which can cause differential development (spatially and temporally) leading to noticeable image quality defects, a condition called wire history. The distribution must also not contain excessive amounts of high charge toner, as this will reduce developability and transfer.

Additionally, the toner charge level and toner charge distribution must be maintained over a wide range of area coverage (AC) and job run length. Since the device of the invention is preferably a full color machine aimed at the offset market, AC and job run length will vary over a broad range. Print jobs such as annual reports will contain predominantly black text, with cyan, magenta and yellow used only for "spot color" applications such as logos, charts and graphs. For full color pictorials, the job can range from very light pastels, with mostly cyan, magenta and yellow, and very little black, to dark rich colors with high usage of cyan, magenta and yellow. In some scenarios, black will be used as replacement for equal amounts of cyan, magenta and yellow to reduce the overall toner layer thickness. Each scenario has a unique combination of AC for each of the colors cyan, magenta, yellow and black. Toner charge level and distribution cannot vary based on the corresponding average residence time of a toner in the housing (i.e., high AC=low residence time with a lot of turnover of toner in the housing; conversely low AC=high residence time).

It is desired that freshly added toner rapidly gains charge to the same level of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner which has no net charge may be available for development onto the photoreceptor. Conversely, when freshly added toner charges to a level higher than that of toner already in the developer, a phenomenon known as "charge-thru" occurs. Also characterized by a bimodal distribution, in this case the low charge or opposite polarity toner is the incumbent toner (or toner that is present in the developer prior to the addition of fresh toner). The failure modes for both slow admix and charge-thru are the same as those for low charge toner state above, most notably background and dirt in the machine, wire history, interactivity, and poor text quality.

Therefore, it is desirable to design toner and developer materials to have an average toner charge level that avoids failure modes of both too high and too low toner charge. This will preserve development of solids, halftones, fine lines and text, as well as prevention of background and image contamination. The distribution of toner charge level must be sufficiently narrow such that the tails of the distribution do not adversely affect image quality (i.e., the low charge population is not of sufficient magnitude so as to degrade the image quality attributes known to be related to low toner charge level). Toner charge level and distribution must be maintained over the full range of customer run modes job run length and AC).

High average toner charge, and narrow charge distributions are required under all run conditions (area coverage and job run length) in the present invention. In the invention, appropriate additives as discussed below are chosen to enable high toner charge and charge stability.

The charge of a toner is described in terms of either the charge to particle mass, Q/M, in $\mu$C/g, or the charge/particle diameter, Q/D, in fC/$\mu$m following triboelectric contact of the toner with carrier particles. The measurement of Q/M is accomplished by the well-known Faraday Cage technique. The measurement of the average Q/D of the toner particles can be done by means of a charge spectrograph apparatus as well known in the art. The spectrograph is used to measure the distribution of the toner particle charge (Q in fC) with respect to a measured toner diameter (D in $\mu$m). The measurement result is expressed as percentage particle frequency (in ordinate) of same Q/D ratio on Q/D ratio expressed as fC/10 $\mu$m (in abscissa). The distribution of the frequency over Q/D values often takes the form of a Gaussian or Lorentzian distribution, with a peak position (most probably Q/D value) and peak width (characterized, for example, by the width of the peak in fC/$\mu$m at a frequency value of half of the peak value). From this full distribution an average Q/D value can be calculated. In certain circumstances the frequency distribution will consist of two or more distinct peaks, as in the slow admix and charge-thru behaviors discussed above.

In order to attain the print quality discussed above when used in an HSD developer apparatus of the preferred embodiment of the present invention, the Q/D of the toner particles must have an average value of from, for example, −0.1 to −1.0 fC/μm, preferably from about −0.5 to −1.0 fC/μm. This charge must remain stable throughout the development process in order to insure consistency in the richness of the images obtained using the toner. Thus, the toner charge should exhibit a change in the average Q/D value of at most from, for example, 0 to 0.25 fC/μm. The charge distribution of the toner, as measured by a charge spectrograph, should be narrow, that is possessing a peak width of less than 0.5 fC/μm, preferably less than 0.3 fC/μm, and substantially unimodal, that is, possessing only a single peak in the frequency distribution, indicating the presence of no or very little low charge toner (too little charge for a sufficiently strong coulomb attraction) and wrong sign toner. Low charge toner should comprise no more than, for example, 6% of the total toner, preferably no more than 2%, while wrong sign toner should comprise no more than, for example, 3% of the total toner, preferably no more than 1%.

Using the complementary well known Faraday cage measurement, in order to attain the print quality discussed above when used in an HSD developer apparatus of the preferred embodiment of the present invention, the toner must also preferably exhibit a triboelectric value of from, for example, −25 to −70 μC/g, more preferably −30 to −60 μC/g. The tribo must be stable, varying at most from, for example, 0 to 15 μC/g, preferably from no more than 0 to 8 μC/g.

The print quality requirements for the HSD product translate into toner functional properties, as discussed above. By this invention, functionality is designed into the toners with the goal of meeting the many print quality requirements. Four different color toners, cyan (C), magenta (M), yellow (Y) and black (K), are typically used in developing full color images (although other color toners may also be used). Each of theses color toners in the present invention are preferably comprised of resin binder, appropriate colorants and an additive package comprised of one or more additives. Suitable and preferred materials for use in preparing toners of the invention that possess the properties discussed above will now be discussed. The specific formulations used to achieve the functional properties discussed above should not, however, be viewed as restricting the scope of the invention.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

Polyester resins are among the preferred binder resins that are least affected by vinyl or document offset (Property C above).

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

More preferred resin binders for use in the present invention comprise polyester resins containing both linear portions and cross-linked portions of the type described in U.S. Pat. No. 5,227,460 (incorporated herein by reference above).

The cross-linked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

The toner resin has a weight fraction of the microgel (gel content) in the resin mixture in the range typically from about 0.001 to about 50 weight percent, preferably from about 1 to about 20 weight percent, more preferably about 1 to about 10 weight percent, most preferably about 2 to 9 weight percent. The linear portion is comprised of base resin, preferably unsaturated polyester, in the range from about 50 to about 99.999 percent by weight of said toner resin, and preferably in the range from about 80 to about 98 percent by weight of said toner resin. The linear portion of the resin preferably comprises low molecular weight reactive base resin that did not cross-link during the cross-linking reaction, preferably unsaturated polyester resin.

The molecular weight distribution of the resin is thus bimodal, having different ranges for the linear and the cross-linked portions of the binder. The number-average molecular weight (Mn) of the linear portion as measured by gel permeation chromatography (GPC) is in the range of from, for example, about 1,000 to about 20,000, and preferably from about 3,000 to about 8,000. The weight-average molecular weight (Mw) of the linear portion is in the range of from, for example, about 2,000 to about 40,000, and preferably from about 5,000 to about 20,000. The weight average molecular weight of the gel portions is, on the other hand, generally greater than 1,000,000. The molecular weight distribution (Mw/Mn) of the linear portion is in the range of from, for example, about 1.5 to about 6, and preferably from about 1.8 to about 4. The onset glass transition temperature (Tg) of the linear portion as measured by differential scanning calorimetry (DSC) is in the range of from, for example, about 50° C. to about 70° C.

This binder resin can provide a low melt toner with a minimum fix temperature of from about 100° C. to about 200° C., preferably about 100° C. to about 160° C., more preferably about 110° C. to about 140° C., provide the low melt toner with a wide fusing latitude to minimize or prevent offset of the toner onto the fuser roll, and maintain high toner pulverization efficiencies. The toner resins and thus toners show minimized or substantially no vinyl or document offset.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in good solvents such as, for example, tetrahydrofuran, toluene and the like.

Preferred unsaturated polyester base resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof. A particularly preferred polyester is poly(propoxylated bisphenol A fumarate).

In a most preferred embodiment of the present invention, the toner binder resin comprises a melt extrusion of (a) linear propoxylated bisphenol A fumarate resin and (b) this resin cross-linked by reactive extrusion of this linear resin, with the resulting extrudate comprising a resin with an overall gel content of from about 2 to about 9 weight percent. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands, for example. For suitable toner storage and prevention of vinyl and document offset, the polyester resin blend preferably has Tg range of from, for example, 52 to 64° C. Using resin having only the linear portion of the propoxylated bisphenol A fumarate resin does not attain the needed melt rheology profile.

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, bis(t-butyl peroxy) diisopropyl benzene, di-t-butyl peroxide and 2,5-dimethyl 2,5-di(t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy) cyclohexane, 1,1-di(t-amyl peroxy)cyclohexane, 2,2-di(t-butyl peroxy)butane, ethyl 3,3-di(t-butyl peroxy)butyrate, ethyl 3,3-di(t-amyl peroxy)butyrate and 1,1-bis(t-butyl (peroxy) 3,3,5-trimethylcyclohexane. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane) and other similar known compounds.

By permitting use of low concentrations of chemical initiator and utilizing all of it in the cross-linking reaction, usually in the range from about 0.01 to about 10 weight percent, and preferably in the range from about 0.1 to about 4 weight percent, the residual contaminants produced in the cross-linking reaction in preferred embodiments can be minimal. Since the cross-linking can be carried out at high temperature, the reaction is very fast (e.g., less than 10 minutes, preferably about 2 seconds to about 5 minutes) and thus little or no unreacted initiator remains in the product.

The low melt toners and toner resins may be prepared by a reactive melt mixing process wherein reactive resins are partially cross-linked. For example, low melt toner resins may be fabricated by a reactive melt mixing process comprising the steps of: (1) melting reactive base resin, thereby forming a polymer melt, in a melt mixing device; (2) initiating cross-linking of the polymer melt, preferably with a chemical cross-linking initiator and increased reaction temperature; (3) keeping the polymer melt in the melt mixing device for a sufficient residence time that partial cross-linking of the base resin may be achieved; (4) providing sufficiently high shear during the cross-linking reaction to keep the gel particles formed and broken down during shearing and mixing and well distributed in the polymer melt; (5) optionally devolatilizing the polymer melt to remove any effluent volatiles; and (6) optionally adding additional linear base resin after the cross-linking in order to achieve the desired level of gel content in the end resin. The high temperature reactive melt mixing process allows for very fast cross-linking which enables the production of substantially only microgel particles, and the high shear of the process prevents undue growth of the microgels and enables the microgel particles to be uniformly distributed in the resin.

A reactive melt mixing process is a process wherein chemical reactions can be carried out on the polymer in the melt phase in a melt mixing device, such as an extruder. In preparing the toner resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

The resins are generally present in the toner of the invention in an amount of from about 40 to about 98 percent by weight, and more preferably from about 70 to about 98 percent by weight, although they may be present in greater or lesser amounts, provided that the objectives of the invention are achieved.

The toner resins can be subsequently melt blended or otherwise mixed with a colorant, charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in, or on the toner compositions as fusing release agents.

Various suitable colorants of any color without restriction can be employed in toners of the invention, for example wherein the colorant is carbon black, magnetite, or mixtures thereof, cyan, magenta, yellow, blue, green, red, orange, violet or brown, or mixtures thereof, including suitable colored pigments, dyes, and mixtures thereof including Carbon Black, such as REGAL 330 carbon black (Cabot), Acetylene Black, Lamp Black, Anilipe Black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068 FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 9 percent by weight for color toner and about 3 to about 60 percent by weight for black toner.

For the black toner of the invention, the black toner must contain a suitable black pigment so as to provide a Lightness (or L*) no greater than 17 at the operating TMA. In a most preferred embodiment, carbon black is used at a loading of 5% by weight. Carbon black is preferred.

For the cyan toner of the invention, the toner should contain a suitable cyan pigment type and loading so as to enable as broad a color gamut as is achieved in benchmark lithographic four-color presses. In a most preferred embodiment, the pigment is comprised of 30% PV Fast Blue (Pigment Blue 15:3) from SUN dispersed in 70% linear propoxylated bisphenol A fumarate and is loaded into the toner in an amount of 11% by weight (corresponding to about 3.3% by weight pigment loading).

For the yellow toner of the invention, the toner should contain a suitable yellow pigment type and loading so as to enable as broad a color gamut as is achieved in benchmark lithographic four-color presses. In a most preferred embodiment, the pigment is comprised of 30% SUNBRITE Yellow (Pigment Yellow 17) from SUN dispersed in 70% linear propoxylated bisphenol A fumarate and is loaded into the toner in an amount of about 27% by weight (corresponding to about 8% by weight pigment loading).

For the magenta toner of the invention, the toner should contain a suitable magenta pigment type and loading so as to enable as broad a color gamut as is achieved in benchmark lithographic four-color presses. In a most preferred embodiment, the pigment is comprised of 40% FANAL Pink (Pigment Red 81:2) from BASF dispersed in 60% linear propoxylated bisphenol A fumarate and is loaded into the toner in an amount of about 12% by weight (corresponding to about 4.7% by weight pigment loading).

Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

The $SiO_2$ and $TiO_2$ should preferably have a primary particle size greater than approximately 30 nanometers, preferably of at least 40 nm, with the primary particles size measured by, for instance transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 140 to 200% theoretical surface area coverage (SAC), where the theoretical SAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles or the like, for which all of the the additives should preferably have a total SAC×Size range of between, for example, 4500 to 7200. The ratio of the silica to titania particles is generally between 50% silica/50% titania and 85% silica/15% titania, (on a weight percentage basis), although the ratio may be larger or smaller than these values, provided that the objectives of the invention are achieved. Toners with lesser SAC×Size could potentially provide adequate initial development and transfer in HSD systems, but may not display stable development and transfer during extended runs of low area coverage (low toner throughput).

The most preferred $SiO_2$ and $TiO_2$ have been surface treated with compounds including DTMS (dodecyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation, which has an average particle diameter of about 9 microns, as measured in a Coulter counter.

Most preferably, the toners contain from, for example, about 0.1 to 5 weight percent titania, about 0.1 to 8 weight percent silica and about 0.1 to 4 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives may be incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, preferably comprised of both the linear resin and the cross-linked resin as discussed above, and the colorant together in a mixing device, preferably an extruder, and then extruding the mixture. The extruded mixture is then preferably micronized in a grinder along with about 0.3 to about 0.5 weight percent of the total amount of silica to be used as an external additive. The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

In a most preferred embodiment, the process is carefully controlled and monitored in order to consistently achieve toners having the necessary properties discussed above. First, the ingredients are fed into the extruder in a closed loop system from hoppers containing, respectively, the linear resin, the cross-linked resin, the predispersed pigment (i.e., the pigment dispersed in a portion of binder such as linear propoxylated bisphenol A fumarate and is as discussed above) and reclaimed toner fines.

Reclaimed toner fines are those toner particles that have been removed from previously made toner during classification as being too small. As this can be a large percentage of material, it is most preferred to recycle this material back into the method as reclaimed toner fines. This material thus already contains the resins and the colorant, as well as any additives introduced into the toner at the extrusion, grinding, or classification processes. It may comprise anywhere from about 5 to about 50% by weight of the total material added into the extruder.

As the extrudate passes through the die, it is monitored with one or more monitoring devices that can provide feedback signals to control the amounts of the individual materials added into the extruder so as to carefully control the composition and properties of the toner, and thus ensure that a consistent product is obtained. This is quite significant in the present invention, where tight toner functional properties are required as discussed above.

Most preferably, the extrudate is monitored with both an on-line rheometer and a near IR spectrophotometer as the monitoring devices. The on-line rheometer evaluates the melt rheology of the product extrudate and provides a feedback signal to control the amount of linear and cross-linked resin being dispensed. For example, if the melt rheology is too high, the signal indicates that the amount of linear resin added relative to the cross-linked resin should be increased. This monitoring provides control of the toner melt rheology, one of the properties that must be met in order for the performance in an HSD device to be maximized as discussed above, The near IR spectrophotometer, used in transmission mode, can distinguish between the colors as well as monitor colorant concentration. The spectrophotometer can be used to generate a signal to appropriately adjust the amount of colorant added into the extruder. This monitoring provides control over the amount of pigmentation and thereby anables the functionality of toner chroma and can also identify color cross-contamination. By this monitoring, any out-of-specification product can be intercepted at the point of monitoring and purged from the line while in-specification product can continue downstream to the grinding and classification equipment.

In grinding, the addition of a portion of the total amount of silica to be added facilitates the grind and class operations. Specifically, injection into the grinder of between 0.1 and 1.0% of an silica or metal oxide flow aid decreases the level of variability in the output of the grinding operation, allowing better control of the grinding process and allowing it to operate at an optimized level. Additionally, this process enhances the jetting rate of the toner by between 10 and 20 percent. When the toner which is ground in this manner is classified to remove the fine portion of the toner particles, the classification yield and throughput rate are improved which helps control costs during the classification sted where very tight control over particles size and distribution must be maintained for the toner to achieve the properties discussed above.

Classified toner product is then blended with the external surface additives in a manner to anable even distribution and firm attachment of the surface additives, for example by using a high intensity blender. The blended toner achieved has the appropriate level and stability of toner flow and triboelectric properties.

The resulting toner particles can then be formulated into a developer composition. Preferably, the toner particles are mixed with carrier particles to achieve a two-component developer composition.

To meet the print quality attributes discussed above, developer materials must operate in an consistent, predictable manner the same as the toner materials as discussed above. The most significant developer material parameters anabling the toners to so operate, particularly in the hybrid scavengeless development system atmosphere, are developer charge, developer conductivity, developer toner concentration, mass flow and bulk density of the developer, carrier size distribution, carrier magnetic properties and chroma shift.

Below are listed the developer material parameters and the print quality attributes that the parameters influence. Preferred values for the various properties are also described.

G. Developer Charge

The developer charge is correlated with development and transfer (including transfer efficiency and uniformity) performance the same way as the toner charge of the toner (Property F) is as discussed above.

Therefore, again, it is desirable to design toner and developer materials to have an average toner charge level that avoids failure modes of both too high and too low toner charge. This will preserve development of solids, halftones, fine lines and next, as well as prevention of background and image contamination. The distribution of developer and toner charge level must be sufficiently narrow such that the tails of the distribution do not adversely affect image quality (i.e., the low charge population is not of sufficient magnitude so as to degrade the image quality attributes known to be related to low toner charge level). Developer and toner charge level and distribution must be maintained over the full range of customer run modes (job run length and AC).

As in the case of toner charge (Section F), the charge of a toner in the developer is described in terms of either the charge to particle mass, Q/M, in $\mu$C/g, or the charge/particle diameter, Q/D, in fC/$\mu$m following triboelectric contact of the toner with carrier particles. The measurement of Q/M is accomplished by the well-known Faraday Cage technique. The measurement of the average Q/D of the toner particles, as well as the full distribution of Q/D values, can be done by means of a charge spectrograph apparatus as well known in the art. In order to attain the print quality discussed above when used in an HSD developer apparatus of the preferred embodiment of the present invention, the Q/D of the toner particles in the developer must have an average value of from, for example, −0.1 to −1.0 fC/$\mu$m, preferably from about −0.5 to −1.0 fC/$\mu$m. This charge must remain stable throughout the development process in order to insure consistency in the richness of the images obtained using the toner. Thus, the toner charge should exhibit a change in the average Q/D value of at most from, for example, 0 to 25 fC/$\mu$m. The charge distribution of the toner in the developer, as measured by a charge spectrograph, should be narrow, that is possessing a peak width of less than 0.5 fC/$\mu$m, preferably less than 0.3 fC/$\mu$m, and unimodal, that is, possessing only a single peak in the frequency distribution, indicating the presence of no or very little low charge toner (too little charge for a sufficiently strong coulomb attraction) and wrong sign toner. Low charge toner should comprise no more than, for example, no more than 15% of the total number of toner particles, preferably no more than 6% of the total toner, more preferably no more than 2%, while wrong sign toner should comprise no more than, for example, 5% of the total number of toner particles, preferably no more than 3% of the total toner, more preferably no more than 1%. Using the complementary well known Faraday cage measurement, the toner in the developer must also preferably exhibit a triboelectric value of from, for example, −25 to −70 μC/g, more preferably −35 to −60 μC/g. The tribo must be stable, varying at most from, for example, 0 to 15 μC/g, preferably from no more than 0 to 8 μC/g, during development with the toner, for example during development in an HSD system.

The carrier core and coating, as well as the toner additives discussed above, are all chosen to enable high developer charge and charge stability. The processing conditions of the carrier, as well as the levels of toner additives selected, can be manipulated to affect the developer charging level.

H. Developer Conductivity

A hybrid scavengeless development system uses a magnetic brush of a conventional two component system in conjunction with a donor roll used in typical single component systems to transfer toner from the magnetic brush to the photoreceptor surface. As a result, the donor roll must be completely reloaded with toner in just one revolution. The inability to complete reloading of the donor roll in one revolution will result in a print quality defect called reload. This defect is seen on prints as solid areas that become lighter with successive revolutions of the donor roll, or alternately if the structure of an image from one revolution of the donor roll is visible in the image printed by the donor roll on its next revolution, a phenomenon known as ghosting in the art related to single component xerographic development. Highly conductive developers aid in the reduction of this defect. The more conductive developers allow for the maximum transfer of toner from the magnetic brush to the donor roll. Therefore, it is desirable to select developer materials which when combined, are conductive enough to reload the donor roll in a single revolution.

The conductivity of the developer is primarily driven by the carrier conductivity. To achieve the most conductive carrier possible, electrically conductive carrier cores, for example atomized steel cores, with partial coatings of electrically insulating polymers to allow a level of exposed carrier core, are used. An alternative technology of using conductive polymers to coat the carrier core is also feasible. Additionally, irregularly shaped carrier cores provide valleys into which the polymer coating may flow, leaving exposed asperities for more conductive developers. Irregularly shaped carrier cores also function to allow toner particles to contact the surface of the carrier core in the valleys to provide charge to the toner while not interfering with the contact between the uncoated carrier asperities which provides the overall developer conductivity. The addition of zinc stearate to the toner additive package also assists in the lubrication of the carrier and toner, increasing the number of contacts between carrier and toner particles.

Preferably, the conductivity of the developer ranges from, for example, between $10^{-11}$ and $10^{-14}$ $(\text{ohm-cm})^{-1}$, at a toner concentration of between 3.5 and 5.5 percent by weight as measured, for example, across a 0.1 inch magnetic brush at an applied potential of 30 volts. At a toner concentration of between 0 and 0.5 percent, that is bare carrier or carrier that has only a small amount of residual toner on the surface, the carrier has a conductivity of between $10^{-8}$ and $10^{-12}$ $(\text{ohm-cm})_{-1}$ as measured under the same conditions.

I. Developer Toner Concentration

The requirement of the toner concentration level is determined by the requirements of machine set-up. It is therefore critical to be able to blend a developer that will meet the required toner concentration, and control, the concentration of toner to the desired level.

Preferably, the toner concentration ranges from, for example, 1 to 6%, more preferably 3.5 to 5.5%, by weight of the total weight of the developer.

J. Chroma Shift

The toners must have the appropriate color characteristics to enable broad color gamut. The choice of colorants enable the rendition of a higher percentage of standard PANTONE® colors than is typically available from four-color xerography. For each toner, chroma (C*) must be maximized, and it is very important to have the color remain accurate relative to the requested color. Materials in the developer housing can cause the color of the toner to shift as a function of developer age, print area coverage, or other machine operating conditions, which is measured via the difference between the target color and the actual color, specifically as $\Delta E_{CMC}$, (where CMC stands for the Color Measurement Committee of the Society of Dyers and Colorists) which calculates the color change in the three dimensional L*, a*, b* CIELAB space defined in section D. The carrier may contribute to the variation in color, or chroma shift, but may only cause a shift of about $\pm\frac{1}{3}\,\Delta E_{CMC}$ units. Therefore, it is critical to select carrier cores and carrier core coatings that do not contribute to chroma shift of the toner as a function of the state of the developer.

Carrier core and coating polymers must be chosen such that they are lightly colored or colorless and are mechanically robust to the wear experienced in the developer housing. This will prevent a change in $\Delta E_{CMC}$ performance should the carrier coating become abraded. The coating polymer and core should also be robust to mechanical wear that will be experienced in the developer housing. Robustness of the coating polymer would allow the use of darker colored additives to be utilized in the carrier coating without the risk of chroma shift.

Preferably, the $\Delta E_{CMC}$ exhibited over all machine and developer running conditions in all customer environments using the developer and toner of the invention ranges from at most, for example, 0 to 0.60, more preferably from at most, for example, 0 to 0.30.

K. Carrier Size Distribution

Given the small toner size discussed above, it is desirable to also move to a smaller carrier size in order to maintain a ratio of carrier volume median diameter to toner volume median diameter of about 10:1, with the toner volume median as determined by the well known Coulter counter technique and the carrier volume median diameter as determined by well known laser diffraction techniques. This ratio enables a $TC_0$ on the order of 1. This $TC_0$ of 1 translates into a greater tribo sensitivity to toner concentration. This therefore allows the machine control system to use toner concentration as a tuning knob for tribo in the housing. It is also important to maintain a low level of fines in the carrier in order to prevent bead carry-out onto the prints, which generally leads to a print quality defect known as debris-centered deletions (DCDs). Therefore, it is desirable to control the carrier particle size and limit the amount of fine carrier particles.

Given the small toner size discussed above, it is desirable to also move to a smaller size carrier size in order to maintain a ratio of carrier volume median diameter to toner volume median diameter of approximately 10:1. The carrier particles thus should have an average particle size (diameter) of from, for example, about 65 to about 90 microns, preferably from 70 to 84 microns. The fine side of the carrier distribution is well controlled with only about 2.0% of the weight distribution having a size less than 38 microns.

In addition, the developer should exhibit consistent and stable developability, for example exhibiting a stable developed toner mass per unit area (DMA) on the photoreceptor, with a target in the range of between, 0.4 to 1.0 mg/cm$^2$, as measured directly by removal of the toner in given area from the photoreceptor and subsequent weighing or as determined indirectly by a calibrated reflectance measurement from the photoreceptor, at the operational voltages of the development device (for example, at a wire voltage of 200 V in an HSD development device), and a variation of the DMA from the target value of at most 0.4 mg/cm$^2$, most preferably of at most 0.2 mg/cm$^2$. The developer must also exhibit high transfer efficiency to the image receiving substrate with very low residual toner left on the photoreceptor surface following transfer.

The print quality requirements for the HSD product translate into developer functional properties, as discussed above. By this invention, functionality is designed into the toners and developers with the goal of meeting the many print quality requirements. Suitable and preferred materials for use as carriers used in preparing developers containing the above-discussed toners of the invention that possess the properties discussed above will now be discussed.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

In a most preferred embodiment, the carrier core is comprised of atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings and the like.

In a most preferred embodiment, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted.

The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

The carrier particles may be prepared by mixing the carrier core with from, for example, between about 0.05 to about 10 percent by weight, more preferably between about 0.05 percent and about 3 percent by weight, based on the weight of the coated carrier particles, of polymer in until adherence thereof to the carrier core by mechanical impaction and/or electrostatic attraction.

The polymer is most preferably applied in dry powder form and having an average particle size of less than 1 micrometer, preferably less than 0.5 micrometers. Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to a temperature below the decomposition temperature of the polymer coating. For example, the mixture is heated to a temperature of from about 90° C. to about 350° C., for a period of time of from, for example, about 10 minutes to about 60 minutes, enabling the polymer to melt and fuse to the carrier core particles. The coated carrier particles are then cooled and thereafter classified to a desired particle size. The coating preferably has a coating weight of from, for example, 0.1 to 3.0% by weight of the carrier, preferably 0.5 to 1.3% by weight.

In a further most preferred embodiment of the invention, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers of the invention is provided by the temperature at which the carrier coating is applied, higher temperatures resulting in higher tribo up to a point beyond which increasing temperature acts to degrade the polymer coating and thus lower tribo.

With higher tribo, longer development life and improvement in fringe field development is expected.

As discussed above, it is desirable to maintain a ratio of carrier volume median diameter to toner volume median diameter of approximately 10:1. The carrier particles thus should have an average particle size (volume median diameter) of from, for example, about 65 to about 90 microns, preferably from 70 to 89 microns, most 3q preferably from 75 to 85 microns. The size distribution of the carrier particles is further defined such that no more than 10 percent of the carrier particles by weight should have a diameter of less than 50 microns and no more than 10 percent of the carrier particles by weight should have a diameter of greater than 120 microns. The fine side of the carrier distribution is well controlled with only about 2.0% of the weight distribution having a size less than 38 microns, preferably only 1.0% of the weight distribution having a size less than 38 microns.

The carrier particles can be mixed with the toner particles in various suitable combinations. However, best results are obtained when about 1 part to about 5 parts by weight of toner particles are mixed with from about 10 to about 300 parts by weight of the carrier particles, preferably when 3.4 to 5.3 parts by weight of toner particles are mixed with from 90 to 110 parts by weight of the carrier particles. The toner concentration in the developer composition is thus preferably between 3.0 and 5.5% by weight.

In a still further preferred embodiment of the present invention, it has been found that using a carrier core having a shape factor greater than 6 is preferred. The shape factor as used herein is defined as the ratio of BET surface area to the equivalent sphere surface area (ESSA) calculated using the volume median diameter, as measured above by standard laser diffraction techniques, of the core particle. It represents a measure of the surface morphology of the carrier core.

It has been found as an aspect of this invention that carrier conductivity is driven strongly by the core BET surface area, while the triboelectric properties are not strongly affected by the BET surface area.

It is useful to express the surface characteristics of a carrier core not by BET surface area alone, which is specific to a particular core size and density, but by a shape factor which is calculated by dividing the BET surface area by the theoretical surface area of a carrier core assuming a smooth spherical surface. The theoretical surface area, also referred to as the equivalent sphere surface area (ESSA), calculated using the volume median diameter of the core particle is given by $$ESSA = \text{surface area of bead}/(\text{volume of bead} \times \text{density of bead})$$
$$= 4\pi r^2/((4\pi/3)r^3 \times d)$$
$$= 3/rd$$

where r is the radius of the core based on laser diffraction measurement, using for instance a Mastersizer X, available from Malvern Instruments Ltd. and d is the density of the core. For the preferred atomized steel of the invention, the density is 7 g/cm$^3$.

Thus, for a carrier core having a size of, for example, 77 microns, the ESSA is 55.7 cm$^2$/g, derived from (3/(77×10$^{-4}$ $\mu$m×7 g/cm$^3$)).

The core shape factor is a unitless number since it is the core BET surface area divided by the ESSA. As the core shape factor increases, the surface morphology of the core becomes more irregular. It is most preferred to use a carrier core having a shape factor of greater than 6.0, preferably greater than 6.8, and most preferably of 7.0 or more. Cores with such shape factor have not only excellent conductivity (for example, above 10$^{-12}$ mho/cm), but also superior tribo. The most preferred atomized steel available commercially from Hoeganaes Corporation has a shape factor of 7.9.

Related to the shape factor of the core as a preferred embodiment of the present invention, it has been found that using a carrier core having an oxide level less than of 0.24 percent, most preferably less than 0.15 percent by weight of the core, is preferred. In combination with a shape factor of greater than 7.0, carrier cores with oxide levels less than 0.15 percent by weight yield carriers in the present invention which have not only excellent conductivity (for example, above 10$^{-}$ mho/cm), but also superior tribo.

The toners of the invention are preferably used together as a set of developers wherein different colors of the toners of the set are used to develop a latent image upon a photoreceptor surface by image-on-image processing with hybrid scavengeless development, the developed image then being transferred to an image receiving substrate.

The invention will now be further illustrated by way of the following examples.

EXAMPLES 1–6—BLACK TONER

Examples 1

A black toner is prepared containing 5% by weight carbon black in a propoxylated bisphenol A fumarate resin having a gel content of about 5% by weight. The toner also comprises 4.2% by weight DTMS treated silica, 2.5% by weight DTMS treated titania and 0.3% by weight Zinc Stearate L.

The toner has a volume median particle size of about 7.3 $\mu$m, with percent fines less than 5 $\mu$m of no more than 15% by number as measured by a Coulter Counter.

This toner is formed into a developer by combining with a carrier comprised of a 77 $\mu$m steel core (supplied by Hoeganaes Corporation) coated with 1% by weight PMMA (supplied by Soken) at 200° C.

Test A

Procedure: The developer is run in a xerographic device running in discharged area development only and using a hybrid scavengeless development subsystem (see U.S. Pat. No. 4,868,600) for 15,000 prints at 2% area coverage (AC), followed by 2,500 prints at 50% AC.

By percent of area coverage is meant that percentage of an 8½×11 sheet of paper covered with the toner. Typically, 2% AC is a minimum in operation, and 50% AC is a maximum. 2% AC requires the toner to remain in the housing for a lengthy time prior to use, and thus is used to indicate the aging properties of the toner/developer. 50% AC, on the other hand, requires rapid dispensing of the developer, and thus is used to indicate the ability of the toner/developer to rapidly admix and charge.

Results: The toner concentration is held between 4.1 and 4.9% during the entire test. Tribo is stable and averages −20.9 $\mu$C/g during 2% AC and −18.3 $\mu$C/g during 50% AC. At the end of 2% AC, the charge distribution is narrow and unimodal with a peak Q/D of $\mu$0.33 fC/$\mu$m. Five hundred prints after the transition from 2 to 50% AC, the charge distribution remains narrow and unimodal with a peak Q/D of −0.34 fC/$\mu$m. Developability is stable over the entire test.

The target developed mass per unit area (DMA) of 0.55 mg/cm$^2$ is met by the developer at a Vem of between 110 and 150V during the entire test. Vem is the voltage between the donor roll and wire contacting the donor roll of the HSD subsystem. Even at 400 Vem the DMA is still observed to increase with increasing voltage, indicating excellent development latitude.

Test B

Procedure: The developer is run in a device containing an HSD system, in an environment controlled at a relative humidity of 10% and a temperature controlled at 70° F, for 1,500 prints at 20% AC, followed by 1,500 prints at 0% AC and then 1,500 prints at 20% AC.

Results: The toner concentration varies between 3.8 and 5.4% during the test. Tribo is extremely stable with averages of −31.2, −31.7 and −31.0 $\mu$C/g during 20%, 0% and 20% AC, respectively. Developability is stable over the entire test. The target DMA of 0.55 mg/cm$^2$ is met at Vem of between 180 and 230V during the entire test. Even at 400 Vem the DMA is still observed to increase with increasing voltage, indicating excellent development latitude. At the end of the 1,500 prints of zero throughput (0% AC), the charge distribution is narrow with an average Q/D of −0.52 fC/$\mu$m, and no wrong sign toner.

Example 2

A black toner is prepared containing 5% by weight carbon black in a propoxylated bisphenol A fumarate resin having a gel content of about 5% by weight. The toner also comprises 4.0% by weight HMDS treated silica, 2.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a xerographic device running in discharged area development only and using a hybrid scavengeless development subsystem (see U.S. Pat. No. 4,868,600) for 3,500 prints at 5% AC, followed by 3,500 prints at 20% AC, 9,500 prints at 2% AC, and 4,000 prints at 50% AC.

Results: Following the 5% AC break-in, the toner concentration varies between 3.4 and 4.7% over the remainder of test. Tribo is extremely stable with averages of −25.7, −20.8 and −21.3 μC/g during 20%, 2% and 50% AC, respectively. Developability is very strong and stable over all area coverages. In particular, during the low throughput run (2% AC), no decrease in developability is observed.

Test B

Procedure: The developer is run in a fixture used to age developer materials in which a receiver roll takes the place of a photoreceptor, in an environment controlled at a relative humidity of 50% and a temperature controlled at 70° F., for seven hours at 10% AC, followed by 1 hour at 2% AC, 0.5 hours at 20% AC, and 11.5 hours at 10% AC. This is a total of 20 hours of testing, or an equivalent of approximately 120,000 prints.

Results: The toner concentration varies between 3.8 and 5.4% over the test. Tribo is extremely stable during the 11.5 hours of 10% AC running, with an average tribo of −17.8 μC/g (and a standard deviation of 1.04 μC/g. Developability is very stable over the entire test, with an average receiver DMA of 0.51 mg/cm$^2$ (and a standard deviation of 0.03 mg/cm$^2$) at a Vem of 200V. Charge distributions remain narrow throughout the entire test. At the end of 20 hours, average Q/D is −0/34 fC/μm, with no wrong sign toner.

Example 3

A black toner is prepared containing 5% by weight carbon black in a propoxylated bisphenol A fumarate resin having a gel content of about 5% by weight. The toner also comprises 2.6% by weight HMDS treated silica, 1.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test A

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner Concentration varies between 4.1 and 5.7% during the test. Tribo is extremely stable with averages of −32.0, −35.9, −38.8 μC/g during 20%, 0% and 20% AC, respectively. Developability is very strong and stable over all area coverages. At 200 Vem, DMA ranges from 0.50 to 0.58 mg/cm$^2$. At the end of 1,500 prints of zero throughput, the charge distribution is narrow with an average Q/D of −0.59 fC/μm, and no wrong sign toner.

Test B

Procedure: The developer is run in a fixture used to age developer materials in which a receiver roll takes the place of a photoreceptor in an environment controlled at a relative humidity of 50% and a temperature controlled at 70° F. for 6 hours at 2% AC, followed by 2 hours at 10% AC and 1 hour at 0% AC. An admix test is then performed during which 5 minutes of 50% AC is run, the area coverage is reduced back to 0%, and charge spectrograph measurements are preformed periodically to determine the toner charge distribution as the developer is run for an additional hour. This is a total of 10 hours of testing, or an equivalent of approximately 60,000 prints.

Results: The toner concentration is held stable between 4.2 and 5.0% over the test. Tribo is extremely stable during the test with an average tribo of −24.4 and −30.1 μC/g during 2 and 10% AC, respectively. Developability is also very stable over the entire test, with an average receiver DMA of 0.51 mg/cm$^2$ (and a standard deviation of 0.02 mg/cm$^2$) at a Vem of 200V. After 9 hours of testing (end of 1 hour at zero throughput), the charge distribution is narrow with an average Q/D of −0.56 fC/μm, with no wrong sign toner.

Example 4

A black toner is prepared containing 5% by weight carbon black in a propoxylated bisphenol A fumarate resin having a gel content of about 5% by weight. The toner also comprises 5.0% by weight DTMS treated silica, 1.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a xerographic device running in discharged area development only and using a hybrid scavengeless development subsystem (see U.S. Pat. No. 4,868,600) for 3,500 prints at 20% AC, followed by 5 7,500 prints at 2% AC, 3,500 prints at 50% AC, and 8,000 prints of 2% AC.

Results: The toner concentration varies between 3.6 and 4.9% during the entire test. Tribo is extremely stable with averages of −36.6, −32.5 and −32.2 μC/g during 20%, 2% and 50% AC, respectively. Developability is very stable over the entire test, with an average DMA of 0.59 mg/cm$^2$ (and a standard deviation of 0.05 mg/cm$^2$) at a Vem of 200V. Charge distributions remain narrow throughout the entire test. At the end of 2% AC, average Q/D is −0.53 fC/μm, with no wrong sign toner. After the transition to 50% AC, all charge distributions remain unimodal and narrow, with no increase in wrong sign toner or low charge toner. During 50% AC, no toner is measured on the photoreceptor in the area corresponding to background. Moreover, prints taken during this portion of the test display no background (average ΔE from paper in background region of prints during 500 prints at 50% AC=0. 19).

Test B

Procedure: The developer is run in a fixture used to age developer materials in which a receiver roll takes the place of a photoreceptor for 7 hours at 10% AC, followed by 1 hour at 2% AC, 0.5 hours at 20% AC, and 11.5 hours at 10% AC. This is a total of 20 hours of testing, or an equivalent of approximately 120,000 prints.

Results: The toner concentration varies between 3.7 and 5.1% during the 11.5 hours of running time at 10% AC, with an average tribo of −32.2 μC/g (and a standard deviation of 2.61. Developability is very stable over the entire test, with an average receiver DMA of 0.40 mg/cm$^2$ (and a standard deviation of 0.03 mg/cm$^2$) at a Vem of 200V. Charge distributions remain narrow throughout the entire test. At the end of 20 hours, average Q/D is −0.48 fC/μm, with no wrong sign toner.

Example 5

A black toner is prepared containing 5% by weight carbon black in a propoxylated bisphenol A fumarate resin having a gel content of about 5% by weight. The toner also comprises 4.0% by weight DTMS treated silica, 2.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a xerographic device running in discharged area development only and using a hybrid scavengeless development subsystem (see U.S. Pat. No. 4,868,600) for 3,500 prints at 20% AC, followed by 7,500 prints at 2% AC, 3,500 prints at 50% AC, and 8,000 prints of 2% AC.

Results: The toner concentration varies between 3.4 and 4.7% during the entire test. Tribo is extremely stable with averages of −39.2, 43.5, 38.9 μC/g during 20%, 2% and 50% AC, respectively. Developability is very stable over the entire test, with an average DMA of 0.60 mg/cm$^2$ (and a standard deviation of 0.02 mg/cm$^2$) at a Vem of 200V. Charge distributions remain narrow throughout the entire test. At the end of 2% AC, average Q/D is −0.68 fC/μm, with no wrong sign toner. After the transition to 50% AC, all charge distributions remain unimodal and narrow, with no increase in wrong sign or low charge toner. During 50% AC, no toner is measured on the photoreceptor in the area corresponding to background. Moreover, prints taken during this portion of the test display no background (average ΔE from paper in background region of prints during 500 prints at 50% AC=0. 10).

Example 6

A black toner is prepared containing 5% by weight carbon black in a propoxylated bisphenol A fumarate resin having a gel content of about 5% by weight. The toner also comprises 4.0% by weight DTMS treated silica, 2.5% by weight DTMS treated titania and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a device containing an HSD system for 7,000 prints at 13% AC, followed 7,750 prints at 5% AC and 6,000 prints at 20% AC.

Results: The toner concentration varies between 2.3 and 6.3% during the test. Tribo is extremely stable with averages of −46.0, −43.6 and −40.6 μC/g during 13%, 5% and 20% AC, respectively. At the end of 5% AC, average Q/D is −0.71 fC/μm, with no wrong sign toner. After the transition to 20% AC, all charge distributions remain unimodal and narrow, with no increase in wrong sign or low charge toner. Developability is stable throughout the test with an average 0.7 mg/cm$^2$ (and a standard deviation of 0.05 mg/cm$^2$) at a Vem of 250V.

Example 7

A black toner is prepared containing 5% by weight carbon black in a propoxylated bisphenol A fumarate resin having a gel content of about 5% by weight. The toner also comprises 5.0% by weight DTMS treated silica, 1.5% by weight DTMS treated titania and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a device containing an HSD system for 7,000 prints at 13% AC, followed 7,750 prints at 5% AC and 6,000 prints at 20% AC.

Results: The toner concentration varies between 3.5 and 5.1% during the entire test. Tribo is extremely stable with averages of −44.9 and −46.0 μC/g during 5% and 20% AC, respectively. Charge distributions remain narrow throughout the entire test. At the end of 5% AC, average Q/D is −0.65 fC/μm, with no wrong sign toner. After the transition to 20% AC, all charge distributions remain unimodal and narrow, with no increase in wrong sign or low charge toner. During this time, ΔE is measured in the background region of the prints. During 700 prints at 20% AC, ΔE is stable and low, with an average of 0.28. Developability is stable throughout the test with an average DMA of 0.5 mg/cm$^2$ (and a standard deviation of 0.02 mg/cm$^2$) at a Vem of 250V.

EXAMPLES 8–12—CYAN TONER

Example 8

A cyan toner is prepared containing 11% by weight of a dispersion of PV Fast Blue in SPARII (3.3% by weight pigment loading total) in a propoxylated bisphenol A fumarate resin having a gel content of about 5% by weight. The toner also comprises 3.5% by weight DTMS treated silica, 2.0% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test A

Procedure: The developer is run in a xerographic device running in discharged area development only and using a hybrid scavengeless development subsystem (see U.S. Pat. No. 4,868,600) for 3,500 prints at 20% AC, 7,500 at 2% AC and by 3,500 prints at 50% AC.

Results: The toner concentration is held between 4.0 and 5.2% during the entire test. Tribo is very stable during the test, with averages of −39.8, −40.1, −40.1 μC/g during 20%, 2% and 50% AC, respectively. At the end of 2% AC, average Q/D is −0.48 fC/μm, with very little wrong sign toner (corrected wrong sign toner (CWS)=1.7%). During the first 500 prints following the transition from 2 to 50% AC, CWS averages 2.0% and background measured on the prints is very low, with an average ΔE of 0.38 (±0.168). Developability is stable throughout the test with average DMA during 2 and 50% AC of 0.36 (±0.033) and 0.48 (±0.064) mg/cm$^2$ at 200 and 350 Vem, respectively.

Test B

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner concentration varies between 4.1 and 6.1% during the test. Tribo is extremely stable with averages of −36.8, −40.2 and −38.8 μC/g during 20%, 0% and 20% AC, respectively. Developability is stable over the entire test. At the end of 20% AC, DMA is 0.45 mg/cm$^2$ (200 Vem) and 0.57 mg/cm$^2$ (350 Vem). At the end of 0% AC, DMA is 0.47 mg/cm$^2$ (200 Vem) and 0.54 mg/cm$^2$ (350 Vem), indicating stable development with AC. At the end of 0% AC, the charge distribution is extremely narrow with a peak Q/D of −0.74 fC/μm and virtually no wrong sign toner (CWS of 0.38%). During the 1,000 prints of 20% AC following the transition from 0 to 20% AC, the charge distribution remains very narrow with virtually no wrong sign toner. During this timeframe, peak Q/D averages −0.72 fC/μm (±0.121) and CWS and corrected low charge toner (CLC) average 0.5% (+0.22) and 0.7% (±0.27).

Example 9

A cyan toner is prepared containing 11% by weight of a dispersion of PV fast blue in SPARII (3.3% by weight pigment loading total) in a propoxylated bisphenol A fumarate resin having a gel content of about 5% by weight. The toner also comprises 4.0% by weight DTMS treated silica, 2.3% by weight DTMS treated titania, 0.2% by weight H2050, a highly hydrophobic fumed silica with a coating of polydimethyl siloxane units and with amino/ammonium functions chemically bonded onto the surface obtained from Wacker Chemie, and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a device containing an HSD system for 8,000 prints at 13% AC, followed 7,750 prints at 5% AC and 5,000 prints at 20% AC.

Results: The toner concentration varies between 3.7 and 5.0% during the test. Tribo is very stable with averages of −53.4, −54.2 and −48.8 μC/g during 13%, 5% and 20% AC, respectively. Charge distributions remain narrow throughout the entire test. At the end of 5% AC, average Q/D is −0.79 fC/μm, with no wrong sign toner (CWS=1.0%). After the transition to 20% AC, all charge distributions remain unimodal and narrow, with no increase in wrong sign or low charge toner. During the first 750 prints after the transition to 20% AC, the peak Q/D averages −0.91 fC/μm and CWS and CLC average 0.6% (±0.15) and 0.8% (±0.24), respectively. Developability is stable throughout the test with an average DMA of 0.54 mg/cm$^2$ (±0.056) at a Vem of 200V.

Test B

Procedure: The developer is run in a fixture used to age developer materials in which a receiver roll takes the place of a photoreceptor in an environment controlled at a relative humidity of 50% and a temperature controlled at 70° F. for 7 hours at 10% AC, followed by 1 hour at 2% AC, 0.5 hours at 20% AC, and 11.5 hours at 10% AC. This is a total of 20 hours of testing, or an equivalent of approximately 120,000 prints.

Results: The toner concentration varies between 4.0 and 7.2% over the test. Tribo is stable during the test with an average tribo of −44.6 and −42.8 μC/g during 10 and 20% AC, respectively. Charge distributions are narrow and unimodal throughout the entire test. In particular, during the 30 minutes of 20% AC which follows the low throughput aging, the average Q/D is −0.52 fC/μm (±133), and CWS and CLC average 1.3% (±0.78) and 4.5% (±2.80), respectively.

Example 10

A cyan toner is prepared containing 11% by weight of a dispersion of PV fast blue in SPARII (3.3% by weight pigment loading total) in a propoxylated bisphenol A fumarate resin having a gel content of about 5% by weight. The toner also comprises 4.0% by weight DTMS treated silica, 2.3% by weight DTMS treated titania and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a fixture used to age developer materials in which a receiver roll takes the place of a photoreceptor in an environment controlled at a relative humidity of 50% and a temperature controlled at 70° F. for 7 hours at 10% AC, followed by 1 hour at 2% AC, 0.5 hours at 20% AC, and 11.5 hours at 10% AC. This is a total of 20 hours of testing, or an equivalent of approximately 120,000 prints.

Results: The toner concentration is held stable between 4.1 and 5.6% over the test. Tribo is stable during the test with an average tribo of −29.1 and −27.4 μC/g during 10 and 20% AC, respectively. Developability is also stable over the entire test, with an-average receiver DMA of 0.35 mg/cm$^2$ (±0.028) at a Vem of 200V. Charge distributions are narrow and unimodal throughout the entire test. In particular, during the 30 minutes of 20% AC which follows the low throughput aging, the average Q/D is −0.44 fC/μm (±0.031), and CWS and CLC average 1.6% (±0.63), and 5.3% (±1.61), respectively.

Test B

Procedure: The developer is run in a device containing an HSD system for 4,000 prints at 13% AC, followed 8,750 prints at 5% AC and 4,400 prints at 20% AC.

Results: The toner concentration varies between 3.4 and 6.7% during the test. Following a break-in period, tribo averaged −31.4 and −23.9 μC/g during 5% and 20% AC, respectively. Charge distributions are narrow and unimodal throughout the entire test. At the end of 5% AC, average Q/D is −0.45 fC/μm, with no wrong sign toner (CWS=1.3%). After the transition to 20% AC, all charge distributions remain unimodal and narrow, with no increase in wrong sign or low charge toner. During the first 750 prints after the transition to 20% AC, the peak Q/D averages −0.44 fC/μm (±0.017) and CWS and CLC average 0.5% (±0.15) and 0.8% (±0.20), respectively.

Example 11

A cyan toner is prepared containing 11% by weight of a dispersion of PV fast blue in SPARII (3.3% by weight pigment loading total) in a propoxylated bisphenol A fumarate resin having a gel content of about 5% by weight. The toner also comprises 4.0% by weight DTMS treated silica, 2.3% by weight DTMS treated titania, 0.3% by weight of the polydimethyl siloxane treated hydrophobic filmed silica H2050 and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test A

Procedure: The developer is run in a xerographic device running in discharged area development only and using a hybrid scavengeless development subsystem (see U.S. Pat. No. 4,868,600) for 3,500 prints at 20% AC, 7,500 at 2% AC and by 3,500 prints at 50%.

Results: The toner concentration is held between 3.9 and 5.0% during the entire test. Tribo is very stable during the test, with averages of −36.7, −35.3, −28.0 μC/g during 20%, 2% and 50% AC, respectively. At the end of 2% AC, average Q/D is −0.45 fC/μm, with no wrong sign toner (CWS=1.3%). During the first 500 prints following the transition from 2 to 50% AC, all charge distributions remain unimodal and narrow, with no increase in wrong sign or low charge toner. During this time, average Q/D is −0.51 fC/μm (±0.050) and CWS and CLC average 1.6% (±0.63) and 3.8% (±1.60), respectively.

Test B

Procedure: The developer is run in a device containing an HSD system for 3,000 prints at 13% AC, followed 7,750 prints at 5% AC and 4,800 prints at 20% AC.

Results: The toner concentration varies between 3.6 and 5.7% during the test. Tribo is very stable with averages of −43.7 and −40.8 μC/g during 13% and 5% AC, average Q/D is −0.62 fC/μm, with no wrong sign toner (CWS=0.7%). After the transition to 20% AC, all charge distributions remain unimodal and narrow, with no increase in wrong sign or low charge toner. During the first 750 prints after the transition to 20% AC, the peak Q/D averages −0.62 (±0.010) fC/μm and CWS and CLC average 1.2% (±0.72) and 2.2% (±1.54), respectively. Developability is stable throughout the test with an average DMA of 0.59 mg/cm$^2$ (±0.078) at a Vem of 250V.

Example 12

A cyan toner is prepared containing 11% by weight of a dispersion of PV fast blue in SPARII (3.3% by weight pigment loading total) in a propoxylated bisphenol A fumarate resin having a gel content of about 5% by weight. The toner also comprises 1.7% by weight DTMS treated silica, 2.0% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test A

Procedure: The developer is run in a xerographic device running in discharged area development only and using a hybrid scavengeless development subsystem (see U.S. Pat. No. 4,868,600) for 3,500 prints at 20% AC, 7,500 at 2% and by 3,500 prints at 50% AC.

Results: The toner concentration is held between 4.2 and 4.8% during the entire test. Tribo is very stable during the test, with averages of−41.9, −41.3, −38.6 μC/g during 20%, 2% and 50% AC, respectively. At the end of 2% AC, average Q/D is −0.53 fC/μm, with no wrong sign toner (CWS=1.2%). During the first 500 prints following the transition from 2 to 50% AC, all charge distributions remain unimodal and narrow, with no increase in wrong sign or low charge toner. During this time, average Q/D is −0.57 fC/μm ±0.130) and CWS and CLC average 1.5% (±0.40) and 1.8% (±0.51), respectively. Developability is stable throughout the test with average DMA during 2 and 50% AC of 0.57 (±0.110) and 0.72 (±0.140) mg/cm$^2$ at 200 and 350 Vem, respectively.

Examples 13–18—MAGENTA TONER

Example 13

A magenta toner is prepared containing 11.75% by weight of a dispersion of LUPRETON Pink in SPAR (4.7% by weight pigment loading total) in a propoxylated bisphenol A fumarate resin having a gel content of about 5% by weight. The toner also comprises 4.2% by weight DTMS treated silica, 2.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner concentration varies between 4.3 and 6.0% during the test. Tribo is extremely stable with averages of −27.6, −32.0 and −32.3 μC/g during 20%, 0% and 20% AC, respectively. Developability is stable over the entire test. At the end of 20% AC, DMA is 0.68 and 0.78 mg/cm$^2$ at Vem of 200 and 350V, respectively. Charge distributions are narrow and unimodal throughout the entire test. At the end of 0% AC, the peak Q/D is −0.62 fC/μm and there is no wrong sign toner (CWS=0.3%). During the 1,000 prints following the transition from 0 to 20% AC, the peak Q/D averages −0.68 fC/μm and CWS and CLC average 0.4% and 0.6%, respectively.

Example 14

A magenta toner is prepared containing 11.75% by weight of a dispersion of LUPRETON Pink in SPARII (4.7% by weight pigment loading total) in a propoxylated bisphenol A fumarate resin having a gel content of about 5% by weight. The toner also comprises 3.5% by weight HMDS treated silica, 2.0% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner concentration varies between 4.3 and 7.6% during the test. Following the break-in, tribo is extremely stable with averages of −35.6 and −34.0 μC/g during 0% and 20% AC. Developability is stable over the entire test. At a Vem of 200V, DMA is 0.50 and 0.52 mg/cm$^2$ at the end of 20% and 0% AC, respectively. At those same intervals, DMA at a Vem of 350V is 0.66 and 0.62 mg/cm$^2$. Therefore the DMA is high and still increasing with increasing voltage, indicating excellent development latitude. Charge distributions are narrow and unimodal throughout the entire test. At the end of 0% AC, the peak Q/D is −0.65 fC/μm and there is no wrong sign toner (CWS−0.6%). During the 1,000 prints following the transition from 0 to 20% AC, the peak Q/D averages −0.69 fC/μm and CWS and CLC average 0.6% and 0.8%, respectively.

Example 15

A magenta toner is prepared containing 11.75% by weight of a dispersion of LUPRETON Pink in SPARII (4.7% by weight pigment loading total) in a propoxylated bisphenol A fumarate resin having a gel content of about 5% by weight. The toner also comprises 4.0% by weight HMDS treated silica, 2.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a xerographic device running in discharged area development only and using a hybrid scavengeless development subsystem (see U.S. Pat. No. 4,868,600) for 3,500 prints at 20% AC, 7,500 at 2% AC and by 3,500 prints at 50% AC.

Results: The toner concentration is held between 4.2 and 5.4% during the entire test. Tribo is very stable during the test, with averages of −30.5, −28.6, −26.3 μC/g during 20%, 2% and 50% AC, respectively. At the end of 7,500 prints at 2% AC, the charge distribution is narrow with an average Q/D of −0.36 fC/μm, and with CWS and CLC of 1.3 and 2.2%, respectively. Following the transition from 2 to 50% AC, the charge distribution remains narrow and unimodal. In particular, during the first 500 prints of 50% AC after the transition, the peak Q/D averages −0.41 fC/μm and CWS and CLC average 1.3% and 2.1%, respectively. During that same time period, background measured on the prints is very low, with an average ΔE of 0.16 (and a standard deviation of 0.075 ΔE). Background measured on the photoreceptor is also very low with an average density of 0.0008 mg/cm$^2$ (and a standard deviation of 0.00033 mg/cm$^2$).

Example 16

A magenta toner is prepared containing 11.75% by weight of a dispersion of LUPRETON Pink in SPARII (4.7% by weight pigment loading total) in a propoxylated bisphenol A fumarate resin having a gel content of about 5% by weight. The toner also comprises 4.5% by weight HMDS treated silica, 1.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a xerographic device running in discharged area development only and using a hybrid scavengeless development subsystem (see U.S. Pat. No. 4,868,600) for 3,500 prints at 20% AC, 7,500 at 2% AC and by 3,500 prints at 50% AC.

Results: The toner concentration is held between 3.5 and 4.9% during the entire test. Tribo is high and stable during the test, with averages of −65.5, −51.4 and −56.8 μC/g during 20%, 2% and 50% AC, respectively. At the end of 7,500 prints at 2% AC, the charge distribution is narrow with an average Q/D of −0.82 fC/μm. Following the transition from 2 to 50% AC, the charge distribution remains narrow and unimodal. In particular, during the first 3,500 prints of 50% AC after the transition, the peak Q/D averages −0.81 fC/μm and CWS and CLC average 1.9% and 3.4%, respectively. During the first 500 prints at 50% AC following the transition from 2% AC, background measured on the prints is very low, with an average ΔE of 0.19 (and a standard deviation of 0.066 ΔE). Developability is extremely stable throughout the test with an average DMA of 0.50 mg/cm$^2$ (and a standard deviation of 0.033 mg/cm$^2$) at a Vem of 200V, and an average DMA of 0.68 mg/cm$^2$ (and a standard deviation of 0.032 mg/cm$^2$) at a Vem of 350V.

Example 17

A magenta toner is prepared containing 11.75% by weight of a dispersion of LUPRETON Pink in SPARII (4.7% by weight pigment loading total) in a propoxylated bisphenol A fumarate resin having a gel content of about 5% by weight. The toner also comprises 4.5% by weight HMDS treated silica, 2.0% by weight DTMS treated titania and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a full process color printer using an HSD system for 5,000 prints at 23% AC, followed 10,000 prints at 2% AC and 5,000 prints at 50% AC.

Results: The toner concentration is held stable between 4.0 and 5.2% during the test. Tribo is extremely stable with averages of −43.6, −41.5 and −36.1 μC/g during 23%, 2% and 50% AC, respectively. Charge distributions remain narrow throughout the entire test. At the end of 2% AC, average Q/D is −0.60 fC/μm, with no wrong sign toner (CWS=0.4%). After the transition to 50% AC, all charge distributions remain unimodal and narrow, with no increase in wrong sign or low charge toner. During the first 500 prints after the transition to 50% AC, the peak Q/D averages −0.63 fC/μm and CWS and CLC average 0.7% and 1.0%, respectively. Developability is extremely stable throughout the test with an average image ΔE of 95.3 (and a standard deviation of 0.31 mg/cm$^2$) at a Vem of 350V. The minimum target ΔE is 91.0.

Example 18

A magenta toner is prepared containing 11.75% by weight of a dispersion of LUPRETON Pink in SPARII (4.7% by weight pigment loading total) in a propoxylated bisphenol A fumarate resin having a gel content of about 5% by weight. The toner also comprises 5.0% by weight HMDS treated silica, 1.5% by weight DTMS treated titania and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a full process color printer using an HSD system for 5,000 prints at 23% AC, followed 10,000 prints at 25 AC and 5,000 prints at 50% AC.

Results: The toner concentration is held stable between 3.7 and 6.7% during the test. Following the break in, tribo is extremely stable with averages of −36.2 and −33.8 μC/g during 2% and 50% AC, respectively. Charge distributions remain narrow throughout the entire test. At the end of 2% AC, average Q/D is −0.59 fC/μm, with no wrong sign toner (CWS=1.4%). After the transition to 50% AC, all charge distributions remain unimodal and narrow, with no increase in wrong sign or low charge toner. During the first 500 prints after the transition to 50% AC, the peak Q/D averages −0.56 fC/μm and CWS and CLC average 1.8% and 2.8%, respectively. During that same time period, background measured on the prints is very low, with an average ΔE of 0.35 (and a standard deviation of 0.227 ΔE).

EXAMPLES 19–23—YELLOW TONER

Example 19

A yellow toner is prepared containing 26.67% by weight of a dispersion of SUNBRITE Yellow in SPARII (8.0% by weight pigment loading total) in a propoxylated bisphenol A fumarate resin having a gel content of about 5% by weight. The toner also comprises 4.2% by weight DTMS treated silica, 2.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner concentration varies between 4.2 and 7.7% during the test. Tribo is extremely stable with averages of −38.6, −40.8 and −40.0 μC/g during 20%, 0% and 205 AC, respectively. Developability is stable over the entire test. At a Vem of 200V, DMA is 0.47 and 0.44 mg/cm$^2$ at the end of 20% and 0% AC, respectively. At those same intervals, DMA at a Vem of 350V is 0.52 mg/cm$^2$. Therefore the DMA is high and still increasing with increasing voltage, indicating excellent development latitude. During the test, there is virtually no low charge toner, with CWS and CLC averaging 0.5 and 1.1%, respectively.

Example 20

A yellow toner is prepared containing 26.67% by weight of a dispersion of SUNBRITE Yellow in SPARII (8.0% by weight pigment loading total) in a propoxylated bisphenol A fumarate resin having a gel content of about 5% by weight. The toner also comprises 2.6% by weight HMDS treated silica, 1.5% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test

Procedure: The developer is run in a device containing an HSD system in an environment controlled at a relative humidity of 10% and a temperature controlled at 70° F. for 1,500 prints at 20% AC, followed by 1,500 prints at 0% AC and 1,500 prints at 20% AC.

Results: The toner concentration varies between 4.3 and 5.3% during the test. Tribo is extremely stable with averages of −46.3, −49.4 and −43.6 μC/g during 20%, 0% and 20% AC, respectively. Developability is stable over the entire test. At a Vem of 200V, DMA is 0.38 and 0.38 mg/cm$^2$ at the end of 20% and 0% AC, respectively. At those same intervals, DMA at a Vem of 350V is 0.52 and 0.49 mg/cm$^2$, respectively. Therefore the DMA is high and still increasing with increasing voltage, indicating excellent development latitude. During the test, there is virtually no low charge toner, with CWS and CLC averaging 0.4 and 0.6%, respectively.

Example 21

A yellow toner is prepared containing 26.67% by weight of a dispersion of SUNBRITE Yellow in SPARII (8.0% by weight pigment loading total) in a propoxylated bisphenol A fumarate resin having a gel content of about 5% by weight. The toner also comprises 4.5% by weight DTMS treated silica, 2.7% by weight DTMS treated titania, 0.3% by weight H2050 and 0.5% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 200° C.

Test A

Procedure: The developer is run in a fixture used to age developer materials in which a receiver roll takes the place of a photoreceptor in an environment controlled at a relative humidity of 50% and a temperature controlled at 70° F. for 7 hours at 10% AC, followed by 1 hour at 2% AC, 0.5 hours at 20% AC, and 11.5 hours at 10% AC. This is a total of 20 hours of testing, or an equivalent of approximately 120,000 prints.

Results: The toner concentration is held stable between 4.0 and 5.4% over the test. Tribo is extremely stable during the test with an average tribo of −36.1 and −37.2 μC/g during 10 and 20% AC, respectively. Developability is also stable over the entire test, with an average receiver DMA of 0.37 mg/cm$^2$ (and a standard deviation of 0.06 mg/cm$^2$) at a Vem of 200V. Charge distributions are narrow and unimodal throughout the entire test. In particular, during the 30 minutes of 20% AC that follows the low throughput aging, the average Q/D is −0.50 fC/μm and CWS and CLC average 0.9% and 2.2%, respectively.

Test B

Procedure: The developer is run in a device containing an HSD system for 7,000 prints at 13% AC, followed 8,750 prints at 5% AC and 5,000 prints at 20% AC.

Results: The toner concentration is held stable between 4.0 and 4.9% during the test. Tribo is extremely stable with averages of −43.9, −45.4 and −42.8 μC/g during 13%, 5% and 205 AC, respectively. Charge distributions remain narrow throughout the entire test. At the end of 5% AC, average Q/D is −0.68 fC/μm, with no wrong sign toner (CWS= 0.3%). After the transition to 20% AC, all charge distributions remain unimodal and narrow, with no increase in wrong sign or low charge toner. During the first 750 prints after the transition to 20% AC, the peak Q/D averages −0.57 fC/μm and CWS and CLC average 0.3% and 0.4%, respectively. Developability is extremely stable throughout the test with an average DMA of 0.56 mg/cm$^2$ (and a standard deviation of 0.015 mg/cm$^2$) at a Vem of 200V.

Example 22

A yellow toner is prepared containing 26.67% by weight of a dispersion of SUNBRITE Yellow in SPARII (8.0% by weight pigment loading total) in a propoxylated bisphenol A fumarate resin having a gel content of about 5% by weight. The toner also comprises 4.5% by weight DTMS treated silica, 3.0% by weight DTMS treated titania and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a xerographic device running in discharged area development only and using a hybrid scavengeless development. Subsystem (see U.S. Pat. No. 4,868,600) for 3,500 prints at 20% AC, 7,500 at 2% AC and by 3,500 prints at 50% AC.

Results: The toner concentration is held between 3.9 and 4.8% during the entire test. Tribo is very stable during the test, with averages of −48.0, −46.7, −43.0 μC/g during 20%, 2% and 50% AC, respectively. Following the transition from 2 to 50% AC, the charge distribution remains narrow and unimodal. In particular, during the first 500 prints of 50% AC after the transition, the peak Q/D averages −0.45 fC/μm and CWS and CLC average 1.1% and 1.5%, respectively. During that same time period, background measured on the prints is very low, with an average ΔE of 0.14. Developability is stable throughout the test with average DMA of 0.42 and 0.50 mg/cm$^2$ at 200 and 350 Vem, respectively (with standard deviations of 0.04 and 0.07 mg/cm$^2$).

Example 23

A yellow toner is prepared containing 26.67% by weight of a dispersion of SUNBRITE Yellow in SPARII (8.0% by weight pigment loading total) in a propoxylated bisphenol A fumarate resin having a gel content of about 5% by weight. The toner also comprises 4.0% by weight DTMS treated silica, 2.25% by weight DTMS treated titania, 0.3% by weight of the polydimethyl siloxane treated hydrophobic fumed silica H2050EP and 0.3% by weight Zinc Stearate L.

The toner has a volume median particle size of about 7.3 μm, with percent fines less than 5 μm of no more than 15% by number as measured by a Coulter Counter.

This toner is formed into a developer by combining with a carrier comprised of a 77 μm steel core (supplied by Hoeganaes Corporation) coated with 1% by weight PMMA (supplied by Soken) at 232° C.

Test

Procedure: The developer is run in a xerographic device running in discharged area development only and using a hybrid scavengeless development subsystem (see U.S. Pat. No. 4,868,600) for 3,500 prints at 20% AC, 7,500 at 2% AC and by 3,500 prints at 50% AC.

Results: The toner concentration is held between 3.9 and 5.0% during the entire test. Tribo is very stable during the test, with averages of −47.5, −46.9, −42.7 μC/g during 20%, 2% and 50% AC, respectively. At the end of 7,500 prints at 2% AC, the charge distribution is narrow with an average Q/D of −0.56 fC/μm, and with CWS and CLC of 0.45 and 0.56%, respectively. Following the transition from 2 to 50% AC, the charge distribution remains narrow and unimodal. In particular, during the first 500 prints of 50% AC after the transition, the peak Q/D averages −0.63 fC/μm and CWS and CLC average 0.9% and 1.2%, respectively. During that same time period, background measured on the prints is very low, with an average ΔE of 0.22. Developability is stable throughout the test with average DMA of 0.42 and 0.50 mg/cm$^2$ at 200 and 350 Vem, respectively (with standard deviations of 0.06 and 0.09 mg/cm$^2$).

EXAMPLES 24–27—DEVELOPER

Example 24

In this example, the cyan toner of Example 9 is mixed in a Littleford FM50 horizontal blender (50 L volume) with a carrier comprised of a 77 μm Hoeganaes steel core coated with 1% by weight PMMA that is powder-coated in a rotary kiln furnace at 232° C. to form the developer. The carrier is loaded into the blender at a weight of 100.275 pounds, and the toner is loaded into the blender at a weight of 4.725 pounds for a volume loading of 35%. The blender is operated at a speed of 103 rpm for a total of 20 minutes.

The developer achieved was evaluated and found to have the following properties:

| | | |
|---|---|---|
| Toner concentration | = | 4.45% |
| Tribo | = | 42.77 $\mu$C/g |
| Conductivity (10 V) | = | $1.03 \times 10^{-14}$ |

Example 25

In this example, the yellow toner of Example 21 is mixed in a Littleford FM50 horizontal blender (50 L volume) with a carrier comprised of a 77 $\mu$m Hoeganaes steel core coated with 1% by weight PMMA that is powder-coated in a rotary kiln furnace at 200° C. to form the developer. The carrier is loaded into the blender at a weight of 100.275 pounds, and the toner is loaded into the blender at a weight of 4.725 pounds for a volume loading of 35%. The blender is operated at a speed of 103 r$\mu$m for a total of 20 minutes.

The developer achieved was evaluated and found to have the following properties:

| | | |
|---|---|---|
| Toner concentration | = | 4.51% |
| Tribo | = | 40.24 $\mu$C/g |
| Conductivity (10 V) | = | $9.65 \times 10^{-15}$ |

Example 26

In this example, the black toner of Example 7 is mixed in a Littleford FM50 horizontal blender (50 L volume) with a carrier comprised of a 77 $\mu$m Hoeganaes steel core coated with 1% by weight PMMA that is powder-coated in a rotary kiln furnace at 232° C. to form the developer. The carrier is loaded into the blender at a weight of 100.275 pounds, and the toner is loaded into the blender at a weight of 4.725 pounds for a volume loading of 35%. The blender is operated at a speed of 103 rpm for a total of 20 minutes.

The developer achieved was evaluated and found to have the following properties:

| | | |
|---|---|---|
| Toner concentration | = | 4.34% |
| Tribo | = | 56.25 $\mu$C/g |
| Conductivity (10 V) | = | $1.05 \times 10^{-14}$ |

Example 27

In this example, the magenta toner of Example 15 is mixed in a Littleford FM50 horizontal blender (50 L volume) with a carrier comprised of a 77 $\mu$m Hoeganaes steel core coated with 1% by weight PMMA that is powder-coated in a rotary kiln furnace at 232° C. to form the developer. The carrier is loaded into the blender at a weight of 100.275 pounds, and the toner is loaded into the blender at a weight of 4.725 pounds for a volume loading of 35%. The blender is operated at a speed of 103 rpm for a total of 20 minutes.

The developer achieved was evaluated and found to have the following properties:

Toner concentration=4.45%

Tribo=42.56 $\mu$C/g

Conductivity (10V)=$1.19\times10^{-5}$

Example 28

Carrier Core Shape Factor

In this example, properties of the carrier as related to the carrier core shape factor and oxide level are illustrated. The results for different steel cores are summarized in the following Table 1.

TABLE 1

| Core Properties | | | | Carrier Properties | |
|---|---|---|---|---|---|
| Core | BET SA ($cm^2$/g) | Shape Factor | Oxide Level | Conductivity (mho/cm) | Tribo ($\mu$C/g) |
| Ex. A | 438 | 7.9 | 0.20 | $6.1 \times 10^{-11}$ | 47 |
| Ex. B | 406 | 7.3 | 0.12 | $2.1 \times 10^{-9}$ | 49 |
| Comp. Ex. C | 312 | 5.6 | 0.21 | $2.5 \times 10^{-15}$ | 54 |
| Ex. D | 388 | 7.0 | 0.14 | $1.3 \times 10^{-9}$ | — |

All of these cores possess volume median diameter particle sizes of approximately 77 microns, and the surface morphology is characterized by the BET surface area number listed in Table 1. The core shape factors are therefore calculated by dividing the BET surface area by 55.7. The oxide levels of the cores are also shown in Table 1. Carriers made from these cores are coated with 1% by weight PMMA that is powder-coated in a rotary kiln furnace at 232° C. The triboelectric values of the resulting carriers are not strongly affected by either the core shape factor or oxide level, exhibiting values of 50+/−4 $\mu$C/g. The conductivity values of the resulting carriers are very sensitive to the shape factor. Comparative Example C, which has a shape factor of 5.6 and an oxide level of 0.21, is fully insulative, whereas Example A, which has a shape factor of 7.9 and a comparable oxide level of 0.20, is substantially conductive. Higher levels of conductivity are achieved with shape factors of about 7 or greater and oxide levels of 0.15 or less in Examples B and D.

What is claimed is:

1. A toner comprising toner particles comprised of at least one binder, at least one colorant, and optionally one or more additives, wherein following triboelectric contact with carrier particles, the toner has a charge per particle diameter (Q/D) of from −0.1 to −1.0 fC/$\mu$m with a variation during development of from 0 to 0.25 fC/$\mu$m and the distribution is substantially unimodal and possesses a peak width of less than 0.5 fC/$\mu$m and the toner possesses a charge to mass ratio (Q/M) of from −25 to −70 $\mu$C/g with a variation during development of from 0 to 15 $\mu$C/g, and wherein the toner has a melt viscosity ranging from $4.0\times10^3$ to $1.6\times10^4$ Poise at a temperature of 116° C., and from $6.1\times10^2$to $5.9\times10^3$ Poise at a temperature of 136° C.

2. The toner according to claim 1, wherein the charge to mass ratio of the toner ranges from −30 to −60 $\mu$C/g.

3. The toner according to claim 1, wherein the toner exhibits low charge toner particles of no more than 15% of a total number of toner particles and wrong sign toner particles of no more than 5% of the total number of toner particles.

4. The toner according to claim 1, wherein the toner exhibits low charge toner particles of no more than 6% of a total number of toner particles and wrong sign toner particles of no more than 3% of the total number of toner particles.

5. The toner according to claim 1, wherein the toner particles have a volume median diameter of from 6.9 to 7.9 microns.

6. The toner according to claim 5, wherein the toner particles have a size distribution such that about 30% or less of the total number of toner particles have a size less than 5 microns and about 0.7% or less of a total volume of toner particles have a size greater than 12.7 microns.

7. The toner according to claim 1, wherein the toner particles have a volume median diameter of from 7.1 to 7.7 microns.

8. The toner according to claim 1, wherein the toner has a lower volume ratio GSD of approximately 1.23 and an upper volume GSD of approximately 1.21.

9. The toner according to claim 1, wherein the toner elastic modulus ranges from $6.6\times10^5$ to $2.4\times10^6$ dynes per square centimeter at a temperature of 97° C., from $2.6\times10^4$ to $5.9\times10^5$ dynes per square centimeter at a temperature of 116° C., and from $2.7\times10^3$ to $3.0\times10^5$ dynes per square centimeter at a temperature of 136° C.

10. The toner according to claim 1, wherein the toner melt flow index (MFI) ranges from 1 to 25 grams per 10 minutes at a temperature of 117° C.

11. The toner according to claim 1, wherein the at least one binder has a glass transition temperature of from 52° C. to 64° C.

12. The toner according to claim 1, wherein at least one binder comprises a propoxylated bisphenol A fumarate resin and the toner resin has an overall gel content of from about 2 to about 9 percent by weight of the binder.

13. The toner according to claim 12, wherein the colorant is carbon black, magnetite, or mixtures thereof, cyan, magenta, yellow, blue, green, red, orange, violet or brown, or mixtures thereof.

14. The toner according to claim 13, wherein the optional one or more additives are present as external additives of one or more of silicon dioxide powder, a metal oxide powder or a lubricating agent.

15. The toner according to claim 14, wherein the metal oxide powder is titanium dioxide or aluminum oxide and the lubricating agent is zinc stearate.

16. The toner according to claim 14, wherein the external additives have a SAC×size (theoretical surface area coverage×primary particle size of the external additive in nanometers) of from 4,500 to 7,200.

17. The toner according to claim 1, wherein the toner comprises a set of toners of different colors and wherein each of the toners of different colors develop a latent image upon a photoreceptor surface by image-on-image processing with hybrid scavengeless development, the developed image then being transferred to an image receiving substrate.

18. The toner according to claim 1, wherein the carrier particles for the triboelectric contact with the toner have a conductivity of between $10^{-8}$ and $10^{-12}$ (ohm-cm)$^{-1}$ at a toner concentration of between 0 and 0.5 percent by weight as measured across a 0.1 inch magnetic brush at an applied potential of 30 volts, an average particle diameter of from about 65 to about 90 microns and a size distribution wherein no more than 10 percent by weight of the carrier particles have a diameter of less than 50 microns and no more than 10 percent by weight of the carrier particles have a diameter of greater than 120 microns, and wherein a toner concentration for the triboelectric contact ranges from 1 to 6% by weight.

19. The toner according to claim 1, wherein the carrier particles for the triboelectric contact comprise an atomized steel core at least partially coated with a polymethyl methacrylate polymer such that a coating weight of the coating is from 0.1 to 3.0% by weight of the carrier.

20. The toner according to claim 1, wherein the toner further has a melt viscosity ranging from $3.9\times10^4$ to $6.7\times10^4$ Poise at temperature of 97° C.

21. A toner comprising toner particles comprised of at least one binder, at least one colorant, and optionally one or more additives, wherein following triboelectric contact with carrier particles, the toner has a charge per particle diameter (Q/D) of from −0.1 to −1.0 fC/μm with a variation during development of from 0 to 0.25 fC/μm and the distribution is substantially unimodal and possesses a peak width of less than 0.5 fC/μm and the toner possesses a charge to mass ratio (Q/M) of from −25 to −70 μC/g with a variation during development of from 0 to 15 μC/g, and wherein the toner has a lower volume ratio geometric standard deviation (GSD) of approximately 1.23 and an upper volume GSD of approximately 1.21.

22. The toner according to claim 21, wherein the toner melt viscosity ranges from $3.9\times10^4$ to $6.7\times10^4$ Poise at a temperature of 97° C., from $4.0\times10^3$ $1.6\times10^4$ Poise at a temperature of 116° C., and from $6.1\times10^2$ to $5.9\times10^3$ of 136° C.

23. A toner comprising toner particles comprised of at least one binder, at least one colorant, and optionally one or more additives, wherein following triboelectric contact with carrier particles, the toner has a charge per particle diameter (Q/D) of from −0.1 to −1.0 fC/μm with a variation during development of from 0 to 0.25 fC/μm and the distribution is substantially unimodal and possesses a peak width of less than 0.5 fC/μm and the toner possesses a charge to mass ratio (Q/M) of from −25 to −70 μC/g with a variation during development of from 0 to 15 μC/g, and wherein the toner has an elastic modulus ranging from $6.6\times10^5$ to $2.4\times10^6$ dynes per square centimeter at a temperature of 97° C., from $2.6\times10^4$ to $5.9\times10^5$ dynes per square centimeter at a temperature of 116° C., and from $2.7\times10^3$ to $3.0\times10^5$ dynes per square centimeter at a temperature of 136° C.

24. A toner comprising toner particles comprised of at least one binder, at least one colorant, and one or more additives, wherein following triboelectric contact with carrier particles, the toner has a charge per particle diameter (Q/D) of from −0.1 to −1.0 fC/μm with a variation during development of from 0 to 0.25 fC/μm and the distribution is substantially unimodal and possesses a peak width of less than 0.5 fC/μm and the toner possesses a charge to mass ratio (Q/M) of from −25 to −70 μC/g with a variation during development of from 0 to 15 μC/g, wherein at least one binder comprises a propoxylated bisphenol A fumarate resin and the toner resin has an overall gel content of from about 2 to about 9 percent by weight of the binder, wherein the colorant is carbon black, magnetite, or mixtures thereof, cyan, magenta, yellow, blue, green, red, orange, violet or brown, or mixtures thereof, wherein the one or more additives are present as external additives of one or more of silicon dioxide powder, a metal oxide powder or a lubricating agent, and wherein the external additives have a SAC×size (theoretical surface area coverage×primary particle size of the external additive in nanometers) of from 4,500 to 7,200.

* * * * *